US005606872A

United States Patent [19]

Terasaki

[11] Patent Number: 5,606,872

[45] Date of Patent: Mar. 4, 1997

[54] COMPRESSION TYPE REFRIGERATOR

[75] Inventor: Masatosi Terasaki, Tsuchiura, Japan

[73] Assignee: Hitachi, Ltd., Tokyo, Japan

[21] Appl. No.: 539,552

[22] Filed: Oct. 5, 1995

Related U.S. Application Data

[62] Division of Ser. No. 302,214, Sep. 8, 1994, Pat. No. 5,481,887.

[30] Foreign Application Priority Data

Sep. 13, 1993 [JP] Japan ..... 5-226896

[51] Int. Cl.[6] ..... F25B 43/02; F25B 1/06

[52] U.S. Cl. ..... 62/471; 62/84

[58] Field of Search ..... 62/84, 471, 196.4, 62/500

[56] References Cited

U.S. PATENT DOCUMENTS 3,389,569 6/1968 Endress ..... 62/471 X 3,393,528 7/1968 Endress ..... 62/471 X 5,086,621 2/1992 Starner et al. ..... 62/471 X 5,440,886 8/1995 Malakeev et al. ..... 62/500 X

*Primary Examiner*—William E. Wayner

*Attorney, Agent, or Firm*—Antonelli, Terry, Stout & Kraus, LLP

[57] ABSTRACT

A compression type refrigerator has an evaporator, a condenser, a compressor for compressing a refrigerant gas, an oil tank for storing a lubricating oil, and an oil supply device connected to the oil tank for supplying the lubricating oil to the compressor by an oil pump. The discharge side of the oil pump is connected to the oil tank through an ejector. A pipe connected at one end to the evaporator to take out a refrigerant liquid is connected at the other end to a negative pressure generation portion of the ejector.

4 Claims, 2 Drawing Sheets

COMPRESSION TYPE REFRIGERATOR

This application is a division of application Ser. No. 08/302,214 filed on Sep. 8, 1994, now U.S. Pat. No. 5,481, 887.

BACKGROUND OF THE INVENTION

The present invention relates to a compression type refrigerator, such as a turbo type refrigerator or a displacement type refrigerator.

In a conventional compression type refrigerator having an evaporator, a condenser and a compressor, as disclosed in, for example, Japanese Unexamined Utility Model Publication No. 54-50240, a refrigerant liquid containing a large amount of lubricating oil is introduced into a vessel via a pipe connected to the evaporator to remove the refrigerant liquid therefrom. A coil is provided in the vessel, and a gas such as, for example, the refrigerant gas discharged from the compressor flows through the coil so that the heat of the gas is utilized to vaporize the refrigerant liquid contained in the vessel. The concentrated lubricating oil in the vessel is returned to the oil tank by operation of a valve.

The above-described conventional compression type refrigerator is operated in manually performed batch processing, with a result that a continuous operation thereof requires troublesome operations, thus preventing reduction in human efforts because of required maintenance.

SUMMARY OF THE INVENTION

An object of the present invention is to provide a compression type refrigerator which enables a lubricating oil mixed in a refrigerant liquid to be automatically continuously collected.

To achieve the above object, the present invention provides a compression type refrigerator comprising an evaporator, a condenser, a compressor for compressing a refrigerant gas, an oil tank for storing a lubricating oil, and an oil supply device connected to the oil tank and including an oil pump for supplying the lubricating oil to the compressor. A discharge side of the oil pump is connected to the oil tank through an ejector, and a pipe, connected at an end to the evaporator to remove a refrigerant liquid, is connected at the other end to a negative pressure generation portion of the ejector.

The prevent invention further provides a compression type refrigerator including an evaporator, a condenser, a compressor for compressing a refrigerant gas, an oil tank for storing a lubricating oil, and an oil supply device connected to the oil tank, with the oil supply device including an oil pump for supplying the lubricating oil to the compressor. A first pipe for removing the compressed refrigerant gas is connected to the oil tank through an ejector, and a second pipe connected at one end to the evaporator to remove a refrigerant liquid, is connected to a negative pressure generation portion of the ejector.

The above and other features, objects and advantages of the present invention will become more apparent from the following description of embodiments with reference to the accompanying drawings.

DESCRIPTION OF THE PREFERRED EMBODIMENTS

Figure 1:
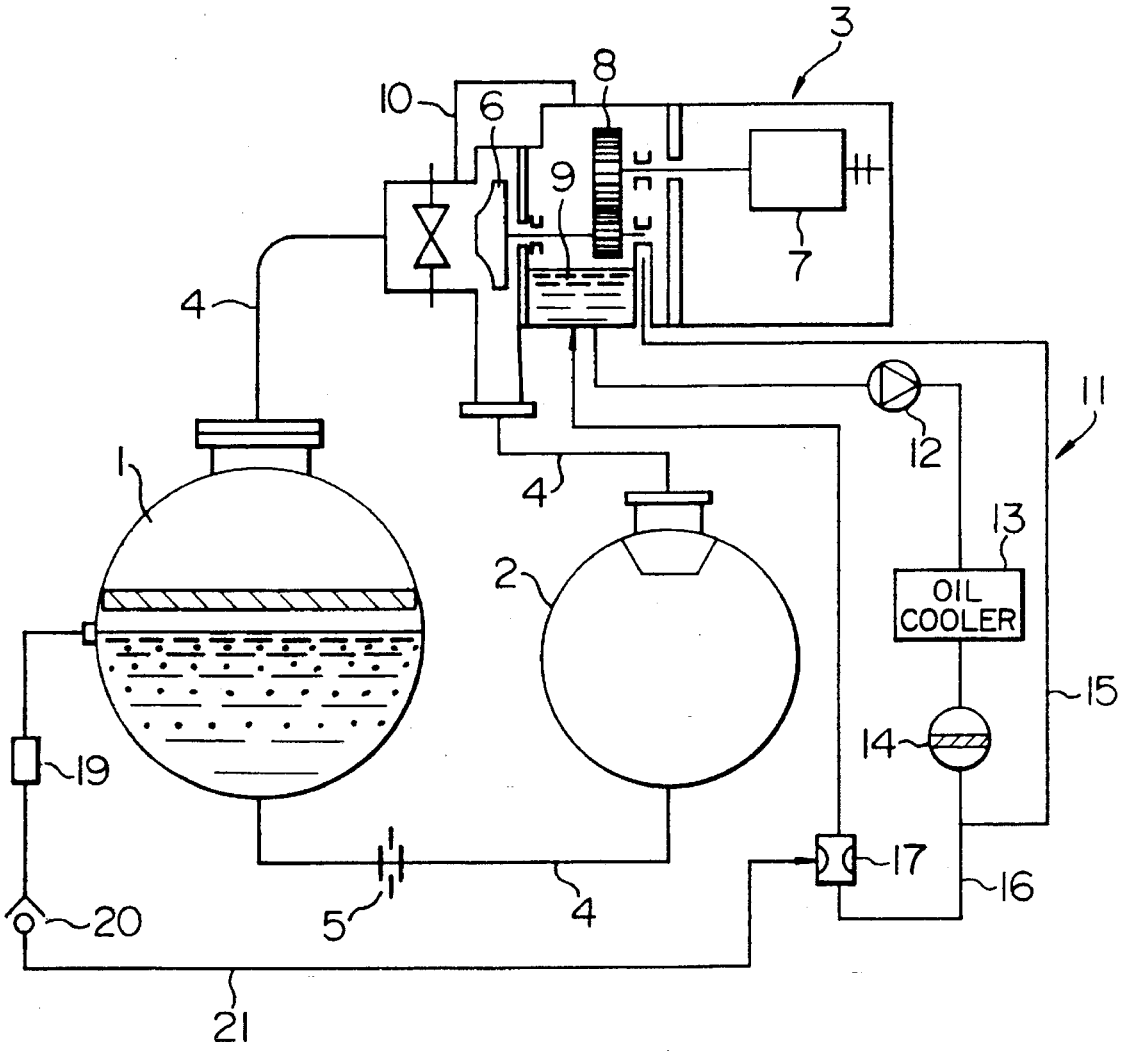
FIG. 1 diagrammatically illustrates an embodiment of the present invention.

As shown in FIG. 1, compression type refrigerator includes an evaporator 1, a condenser 2, a compressor 3 for compressing a refrigerant, a pipe 4 for connecting the evaporator 1, the condenser 2 and the compressor 3 with each other to convey a refrigerant liquid or a refrigerant gas, and a throttling valve 5 provided in the pipe 4 between the evaporator 1 and the condenser 2. The compressor includes an impeller 6, a driving machine 7, a gear train 8 for transmitting a driving force of the driving machine 7 to the impeller 6, an oil tank 9 for storing a lubricating oil, and a pipe 10 for connecting a suction side of the impeller 6 to a rear side of the impeller adjacent the oil tank 9 to balance the pressure between the suction side and the rear side of the impeller. The compressor 3 is further provided with an oil supply device 11 which includes an oil pump 12, an oil cooler 13, an oil strainer 14, and a pipe 15 for connecting the oil pump 12, the oil cooler 13 and the oil strainer 14 to each other to supply the lubricating oil from the oil tank 9 to a portion where lubrication is required, such as the gear train 8 and bearings (not shown). A pipe 16 branches off the pipe 15 of the oil supply device 11 at a discharge side of the oil pump 12 (in the embodiment, at the outlet side of the oil strainer 14) and is connected to the oil tank 9 via an ejector 17. A pipe 21 extends between a portion of the evaporator 1 near a level of the refrigerant liquid when the evaporator 1 is filled with the refrigerant liquid and a negative pressure generating portion of the ejector 17 so as to allow the refrigerant liquid to be removed from the evaporator 1 via a filter drier 19 and a check valve 20.

The operation of the compression type refrigerator will be described below.

When the driving machine 7 begins to drive the refrigerator, the refrigerant gas in the evaporator 1 is suctioned by the impeller 6. The gas compressed by the impeller 6 is introduced into the condenser 2 and is liquified thereby. The refrigerant liquid is cooled as it passes through the throttling valve 5. The cooled refrigerant liquid enters the evaporator 1, where it extracts heat from cooling water which flows through a pipe, to thereby vaporize. The refrigerant vapor is sucked again by the impeller 6, thus completing one cooling cycle. Thereafter, this cooling cycle is repeated. The filter drier 14 prevents the water content or dust in the refrigerant liquid from flowing into the oil tank 9. The check valve 20 prevents flow of the lubricating oil into the pipe 21, which would occur due to the clogging of the ejector 17.

In the oil supply device 11, the oil pump 12 circulates the lubricating oil from the oil tank 9 to the gear train 8, the bearings and so on and back into the oil tank 9 and repeats the circulation.

Further, the part of the refrigerant liquid which stays near the level thereof in the evaporator 1 contains a large amount of lubricating oil having a smaller specific gravity. This part of the refrigerant liquid is suctioned into the pipe 21 by the effects of the ejector 17. After the refrigerant liquid is mixed with the lubricating oil in the ejector 17, the mixture is returned to the oil tank 9. Consequently, even if mist of the lubricating oil flows through the pipe 10 into the suction side of the impeller 6 together with the refrigerant vapor, the amount of lubricating oil in the oil tank 9 remains the same.

To avoid excessive supply of the refrigerant liquid from the evaporator 1 to the oil tank 9, the diameter of the port of the ejector 17 is set to an adequate value. In this manner, the oil in the oil Lank 9 can be kept at an adequate level.

According to the embodiment of FIG. 1, it is possible to automatically and continuously collect the lubricating oil mixed in the refrigerant liquid.

Figure 2:
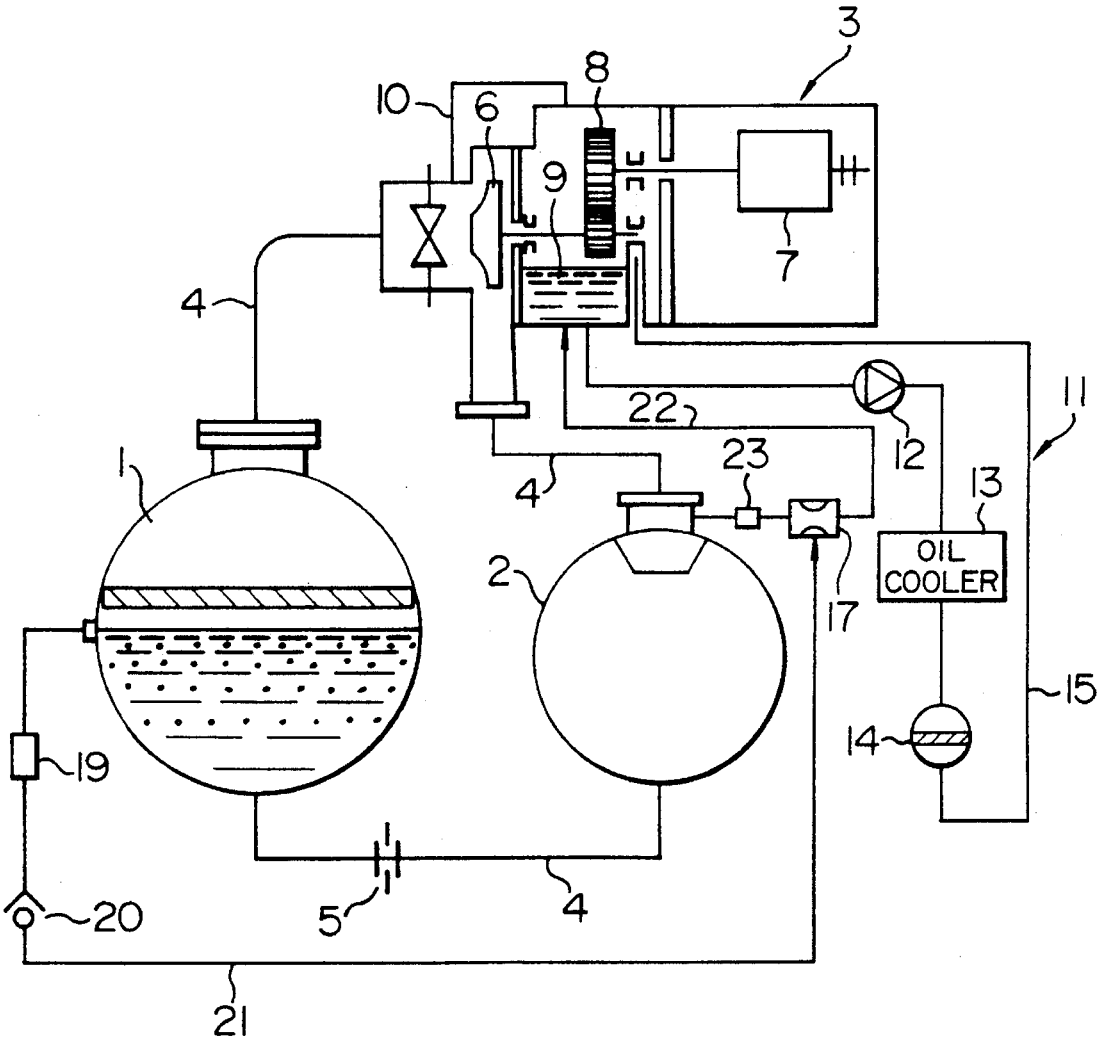
FIG. 2 diagrammatically illustrates another embodiment of the present invention.

FIG. 2 shows another embodiment which employs a high-pressure refrigerant gas discharged from the impeller 6 in place of the lubricating oil pressurized by the pump 12.

A pipe 22 branches off the pipe 4 between the discharge side of the impeller 6 and the condenser 2. The pipe 22 is connected to the oil tank 9 via a pressure-reducing valve 23 and the ejector 17. The pipe 21, connected to a portion of the evaporator 1 near the level of the lubricating oil contained in the evaporator 1, is connected to the negative pressure generating portion of the ejector 17 to return the refrigerant liquid containing a large amount of lubricating oil, located near the level of the refrigerant liquid in the evaporator 1, to the oil tank 9. The pressure-reducing valve 23 prevents the occurrence of the pressure loss which would occur by bypassing the refrigerant gas at an unduly high rate but assures a minimum amount of pressure required to activate the ejector 17.

According to the embodiment of FIG. 2, it is possible to reduce the capacity of the oil pump from that required in the embodiment shown in FIG. 1.

It is possible according to the present invention to automatically and continuously collect the lubricating oil mixed in the refrigerant liquid.

What is claimed is:

1. A compression type refrigerator comprising an evaporator, a condenser, a compressor for compressing a refrigerant gas, an oil tank for storing a lubricating oil, and an oil supply device connected to said oil tank and including an oil pump for supplying the lubricating oil to said compressor, wherein a first pipe line extends between a discharge side of an impeller of said compressor and said condenser to take out said refrigerant gas from said compressor into said condenser and has a branch line portion having a downstream end connected to said oil tank, an ejector is provided in said branch line portion, and a second pipe line is connected at one end to said evaporator to take out therefrom a refrigerant liquid containing the lubricating oil and connected at the other end to a negative pressure generation portion of said ejector.

2. A refrigerator according to claim 1, wherein a filter drier is provided in said second pipe line.

3. A refrigerator according to claim 1, wherein a pressure-reducing valve is provided in said branch line portion upstream of said ejector.

4. A compression type refrigerator comprising an evaporator, a condenser, a refrigerant compressor having refrigerant inlet and outlet, an oil tank for storing a lubricating oil, and an oil supply device connected to said oil tank and including an oil pump for supplying the lubricating oil to said compressor, a first pipe line extending from said refrigerant outlet of said compressor to said condenser and including a branch line portion having a downstream end connected to said oil tank, an ejector provided in said branch line portion, a pressure-reducing valve provided in said branch line portion upstream of said ejector, a second pipe line connected at one end to said evaporator to take out therefrom a refrigerant liquid containing the lubricating oil and connected at the other end to a negative pressure generation portion of said ejector, and a filter drier provided in said second pipe line.

* * * * *